United States Patent [19]

Shelton

[11] Patent Number: 4,505,516

[45] Date of Patent: Mar. 19, 1985

[54] HYDROCARBON FUEL RECOVERY

[76] Inventor: Robert H. Shelton, 5045 Royal La., Dallas, Tex. 75229

[21] Appl. No.: 497,028

[22] Filed: Sep. 20, 1983

Related U.S. Application Data

[63] Continuation of Ser. No. 170,475, Jul. 21, 1980, abandoned.

[51] Int. Cl.[3] ..... E21C 41/10; C10B 53/06

[52] U.S. Cl. ..... 299/2; 208/8 R; 208/11 R; 299/1; 299/8

[58] Field of Search ..... 299/2, 7, 8, 14, 1; 201/41; 202/83; 208/8 R, 11 R, 370; 166/302; 198/358

[56] References Cited

U.S. PATENT DOCUMENTS

| | | | |
|---|---|---|---|
| Re. 25,098 | 12/1961 | Benson et al. | 198/358 X |
| 1,070,666 | 8/1913 | Carr | 208/83 X |
| 1,263,035 | 4/1918 | Casler | 198/358 |
| 2,177,665 | 10/1939 | Loughrey | 208/11 R X |
| 2,489,702 | 11/1949 | Coast | 208/11 R |
| 2,495,840 | 1/1950 | Findlater | 299/14 X |
| 2,698,283 | 12/1954 | Dalin | 208/11 R |
| 2,800,316 | 7/1957 | Henderson | 299/2 X |
| 2,875,137 | 2/1959 | Lieffers et al. . | |
| 3,011,621 | 12/1961 | Byrnes et al. | 198/358 X |
| 3,162,583 | 12/1964 | Memmingef et al. . | |
| 3,481,720 | 12/1969 | Bennett | 208/11 R X |
| 3,608,698 | 9/1971 | Crall | 198/358 |
| 3,908,865 | 9/1975 | Day | 222/135 |
| 3,953,298 | 4/1976 | Hogan | 208/370 X |
| 4,094,769 | 6/1978 | Brown | 208/11 R |
| 4,101,172 | 7/1978 | Rabbitts | 299/2 |
| 4,117,886 | 10/1978 | Honaker | 208/11 R X |

FOREIGN PATENT DOCUMENTS

| | | | |
|---|---|---|---|
| 117970 | 1/1943 | Australia | 202/83 |

OTHER PUBLICATIONS

Bureau of Mines Technical Progress Report, *Mining and Conversion of Shale Oil,* Katell and Wellman, Oct. 1971, pp. 1–11.

*An Economic Analysis of Oil Shale Operations Featuring Gas Combustion Retorting,* Katell et al., Bureau of Mines, Oct. 1974, pp. 1–18.

*Primary Examiner*—George A. Suchfield

*Attorney, Agent, or Firm*—Sigalos & Levine

[57] ABSTRACT

A system for the extraction of a hydrocarbon fuel from a hydrocarbon fuel-bearing ore comprising means for mining the ore, a plurality of portative retorts for processing the mined ore to produce a hydrocarbon fuel, means for transporting the mined ore to each of said retorts, means coupled to said transport means for regulating the amount of ore transported to a respective retort, and at least one storage device coupled to the retorts for collecting and storing the hydrocarbon fuel. Also disclosed is the method of extracting a hydrocarbon fuel from a hydrocarbon fuel-bearing ore comprising the steps of mining the ore, transporting the ore to a plurality of portative retorts in which the ore is processed to produce a hydrocarbon fuel fluid, and moving the retorts in consonance with movement of the mining of said ore.

13 Claims, 5 Drawing Figures

HYDROCARBON FUEL RECOVERY

This is a continuation, of application Ser. No. 170,475, filed July 21, 1980, now abandoned.

BACKGROUND OF THE INVENTION

This invention relates to a system and method for recovering hydrocarbon fuel from hydrocarbon fuel bearing ores; particularly gasification recovery of oil from oil-bearing shale particularly recovery of oil from oil-bearing shale and coal gasification.

As the energy situation becomes more and more critical, it is important not only to conserve energy, but also to find every possible means of recovering energy from all sources available as economically and as efficiently as possible. In this regard, it is well-known that oil shales exist in large deposits which can be readily mined and pyrolyzed to produce shale oil and that there are large coal reserves; especially in the United States.

The term "oil shale" refers to marlstone, a limestone-like carbonaceous rock that can produce oil when heated to pyrolysis temperatures of about 800° F.–1,000° F. The oil precursor in the shale is an organic polymer substance of high molecular weight referred to as "kerogen". Oil shale is found all over the world and in at least 30 states in the United States with estimates of the amount of oil locked in those formations running into the trillions of barrels. In addition, a large amount of the oil shale formations in the United States with 25 to 30 or more gallons of oil per ton of shale can only be recovered by underground mining techniques.

Present techniques for producing oil from shale require large capital investment, pollution control, handling of raw and spent shale, and the need in some cases for large amounts of water to cool the hot kerogen vapors from the retort or kiln and to slurry and compact the spent shale back into the deposit.

In a modification of retorting applicable to underground mining referred to as in situ mining, a small portion of the rock is removed and the rest is reduced to small particles by explosives and then the particles are burned in place. The oil is collected at the bottom of the natural retort and pumped to the surface.

Regardless of the specific technique employed, in order to produce shale oil in large quantities, enormous expenditures are required with present state of the art techniques. One company estimates that it will have spent more than $100,000,000 by the time its first 9,500 barrel a day retort begins operating. Another company indicates that to produce 48,000 barrels of oil a day, it would need a half dozen 6 story tall retorts, each capable of processing 11,000 tons of shale a day. The company officials estimate that it will cost $1.3 billion to $1.5 billion for that operation. Still another company states that it has spent over $100,000,000 developing modified in situ technology for use at the shale sites and have been testing underground retorting for a number of years. The last three retorts built by this company were big enough for commercial product and were 160 feet square and almost 300 feet high. One collapsed. This company states that to scale operations up to commercial production, it would require 40 underground in situ retorts to produce the 50,000 barrels a day which was set as a goal.

There are at least six significant contributory factors to the continuing lack of economic feasibility for recovery of shale oil. These are high fixed costs of on-site construction of the necessary recovery plants (retorts and the like), the high carrying cost of the land necessary to support the large recovery plants, the uncertainties as to the technological feasibility of large plants due to problems arising from scaling up from small, successful pilot plants, the logistics of handling vast quantities of materials, the high risk premium on the cost of capital to carry out the recovery, and the environmental problems. These same factors have inhibited and largely prevented commercially-successful coal gasification.

Thus, it can be understood why no one in the last century has produced shale oil in the United States in other than small quantities, even though efforts to effect commercial production have been going on since the 1920's and particularly since the early 1970's.

As previously noted, the greatest available source of richest deposits of shale in the United States requires underground mining where it is expected that the usual mining techniques such as large room and pillar mining techniques will have to be used. This necessitates the dual problem of working to recover the shale and, further recovering the oil from the shale.

Another major problem with regard to extracting kerogen from shale is the problem of disposing of the spent shale. Having been exposed to the high temperatures in order to extract the oil, the shale expands in volume by a factor of as much as 150% and the original area mined cannot accomodate all of the expanded spent shale. Attempts to handle the shale by leaving them in dumps has not proven satisfactory. Aside from the unsightliness of such dumps, there is the problem of pollution due to the fact that rains on such dumps can produce a highly alkaline run-off. This necessitates the development of containment devices to prevent any such run-off. There is also the problem of landscaping and revegetation.

The same problems of massive capital expenditure also applies to efforts to make coal gasification a viable commercial reality in the United States even though the underlying technology exists.

SUMMARY OF THE INVENTION

Thus, the present invention relates to a system for economic extraction of hydrocarbon fuels from hydrocarbon-fuel bearing rocks; particularly oil from oil-bearing shale and coal gasification.

The system comprises means for stockpiling the hydrocarbon-fuel bearing rock, a plurality of portative retorts for processing said rock to produce a hydrocarbon fuel, means for transporting said rock from said stockpile to each of said retorts, means on each of said retorts coupled to said transport means for regulating the amount of said rock transported to a respective retort, and at least one storage device coupled to said retorts for collecting and storing said hydrocarbon fuel produced by said retorts.

The invention also relates to a method of extracting a hydrocarbon fuel from hydrocarbon-fuel bearing rock comprising the steps of stockpiling the rock, transporting said rock to a processing site, processing said rock in a plurality of portative retorts at said processing site to produce a hydrocarbon fuel, regulating the amount of rock transported to each retort, and coupling the hydrocarbon fuel produced by said retorts to at least one storage device.

The application is particularly applicable to extraction of oil from oil shale and coal gasification and will be particularly described in connection with the former.

BRIEF DESCRIPTION OF THE DRAWINGS

Numerous other aspects of this invention along with additional objectives, features, and advantages of the invention should now become apparent upon a reading of the following exposition in conjunction with the accompanying drawings in which.

DETAILED DESCRIPTION

Figure 1:
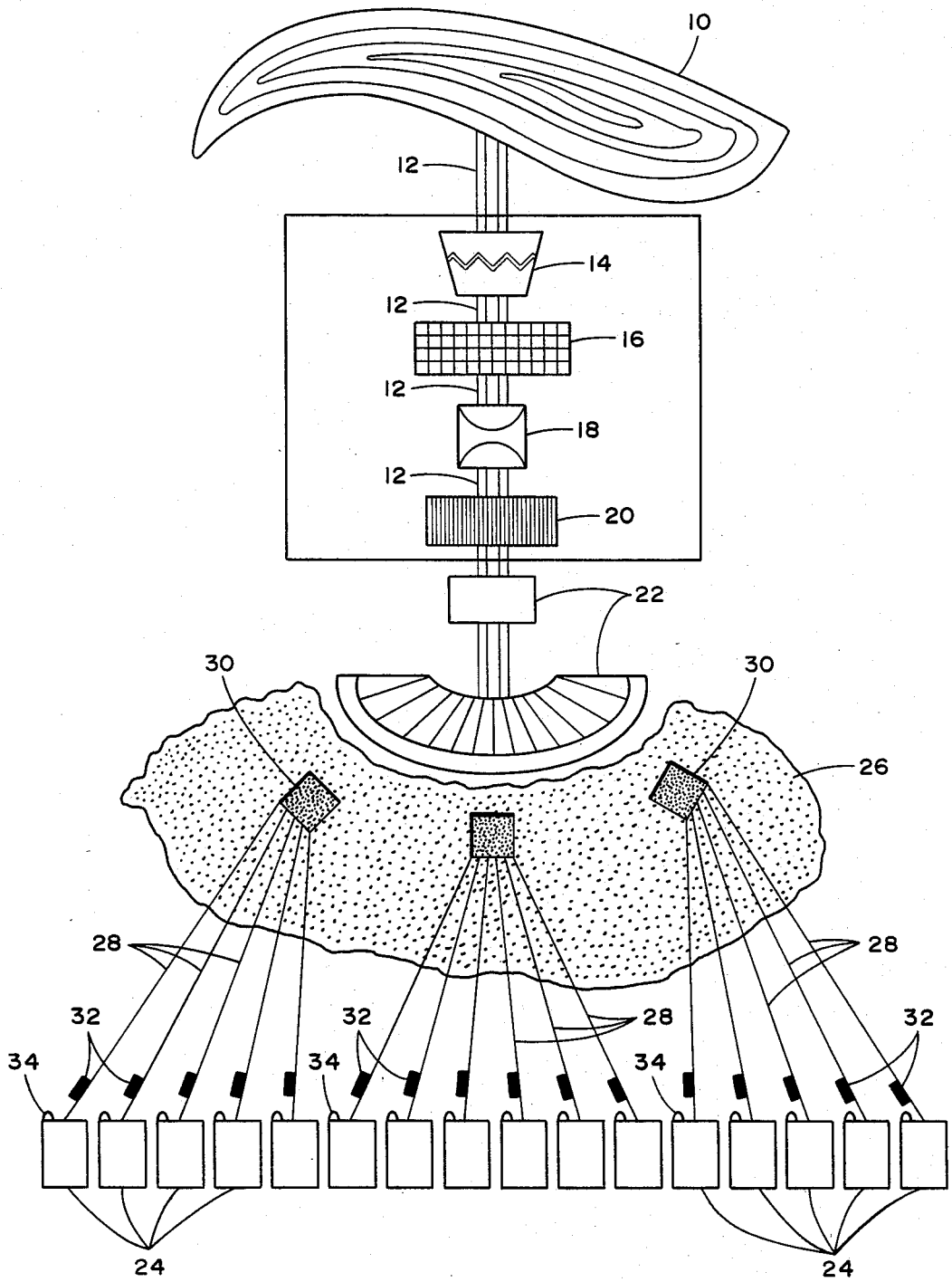
FIG. 1 is a schematic representation of the over-all mining operation.

The instant invention will be described in connection with the recovery of oil from oil shale and particularly in connection with underground mining systems, it being understood that if desired, they can also be used with respect to surface mining, such as strip mining techniques. A critical feature of the system of the instant invention is the ability to utilize proven portative retorts of a size that they can be placed in and operate in, underground mines of the room and pillar type and to move as the mining operation moves. This has significant advantages in both underground as well as surface mining which are described in detail below. As used herein, the term "portative" means portable or movable either by means on the unit itself, or by means of a vehicle, such as a tractor, without any extensive disassembly.

First, the ability to process the shale underground is a tremendous advantage in that it eliminates the need to carry all of the shale to the surface to be retorted and then have to return shale back into the mine for disposal. The only disposal problem with the instant invention in underground mining is for the volume of spent shale that cannot be accomodated by the previously mined area. Thus, the problem of surface containment of spent shale is, in addition, greatly minimized.

Secondly, the problems of emissions is made simpler in that the retorts being placed in the mine and their being limited ways in which the gasses can rise therefrom to the surface, the emissions can be more readily treated to prevent pollution. Also, by having the retorts in the mine, the natural beauty of the areas where mining occurs is largely preserved. In effect, one is able to recover the oil without any of the emission problems resulting from surface retorting.

Portability; i.e., mobility, is also of importance in surface mining in that smaller, mobile units make commercial recovery possible by requiring less land, less reclamation, market entry by moderation, optimization of materials handling, and ability to mix different retort systems to obtain a desired by-product mix.

In addition, the portative retorts are of a size such that they can be produced in a factory and transported as self-contained units or in a few readily assembleable parts to the mining site. This avoids the much larger cost of on-site construction required of large retorts in remote mining areas. The savings in cost are substantial.

While underground in situ mining by the use of creating a rubble in the ground and then using the rubbleized formation for a natural retort has been attempted and is not successful in that the recoveries are low, and of course, a great deal of the oil is lost, it is known also that with room and pillar mining techniques, up to as much as 50 or 60% of shale is left in pillars and hence oil cannot be recovered therefrom. This, of course, results in higher costs and lower production. However, with the instant process, it is contemplated that as certain areas are mined, after movement of the retorts to another area for continuous recovery of additional ore, the sections serving as pillars can be collapsed and the remaining material mined by the rubbleized in situ techniques discussed above. This minimizes, again, the cost of the process and the loss in production. Further, the spent shale can be used as a structural support to eliminate the problems of surface subsidence or mine collapse as experienced by conventional in situ processing.

In short, the instant invention unites the economies of scale available with large mining operations and the economies of scale in small already proven retorts known to be successful. The instant invention unites large mine and crushing operation with a series of small, proven retorts which have been made portative and avoids the costs, uncertainties, and sub-optimization of scale-up to large size retorts.

More particularly, the retorts can be constructed in a factory and trucked to the site, avoiding on-site construction and effecting a large reduction in fixed costs; a reduction as large as 85%; small retorts have already been tested and found successful; the use of smaller portative retorts reduces the necessary amount of land needed for economic feasibility; materials handling by placing the retorts down in the mine is largely obviated; the environmental advantages and cost savings are numerous, particularly with underground mining; and by utilizing smaller, proven retorts and the above economies associated therewith, there is a much lower cost-of-capital to effect recovery of shale oil.

FIG. 1 is a schematic representation of a shale oil recovery operation of the present invention which enables recovery of the shale oil through a plurality of individual retort operational units, each of which, if desired, can be owned by an individual operator thus eliminating the requirement that the entire capital outlay be produced by one company. Further, each of the retorts is portative (mobile) in nature and can be quickly connected to or disconnected from the system or moved as the mining operation is moved.

As can be seen in FIG. 1, the oil-bearing shale is removed by a quarrying operation 10 in any well-known manner. The quarrying operation may be a strip mining operation or it may be an underground mining operation. Both methods are old and well-known and the shale produced thereby is placed on a conveyer belt 12 which carries the shale to a primary crusher 14 which has jaws or other means for reducing the size of the shale in a well-known manner. The output from crusher 14 is carried by conveyor belt 12 to a large screen 16 which separates lumps in excess of the maximum allowable size. The screened shale is then carried by conveyor belt 12 to secondary crusher 18 where the large pieces of shale are further reduced in size. The crushed shale is carried by conveyor belt 12 from secondary crusher 18 to a small screen 20 which extracts shale which is less than a minimum allowable size. The residue is carried by conveyor belt 12 to a radial stacking unit 22. The radial stacker 22 can be any of the commercially available types and stockpiles the oil-bearing shale over a large area covered by movement of the stacker in a semi-circular pattern.

A plurality of individual retorts 24 receive oil-bearing shale from stockpile 26 by means of individual conveyer belts 28. Automatic feeders 30 in stockpile 26 constantly supply the oil-bearing shale to conveyor belts 28.

Each retort 24 has an individual control 32 which is used to adjust its speed and hence the feed rate of the conveyor belt 28 coupled to that particular retort 24. Thus, the amount of shale delivered to each retort can be controlled by means of individual manual control 32. Further, each individual retort 24 has its own monitor 34 which calculates the total volume of raw shale, either in linear feet or gross weight, which is fed to the particular retort and calculates the shale fed to that particular retort. Thus, the shale is delivered in quantities as required by the individual retort and the amount of such shale delivered is measured. For each retort owned by different operators, billing can be made according to the amount of shale received. The oil-bearing shale is fed into the individual retort in the usual manner where it is heated to a temperature (about 800° F.–1,000° F.) which releases the shale oil. The residue from the burning shale is removed as an ash and sold or otherwise discarded. The shale oil is fed into a collection system and the gaseous waste by-products are also coupled to a cleansing system where they are precipitated, filtered and/or detoxified before the final wastes are released into the free atmosphere. All of the individual retorts are shown as coupled into a common collection system and by-products cleansing system, but it is also within the scope of this invention for each retort to have its own pollution control system. It is also contemplated that different retorts can be utilized to form hybrid systems that can obtain a variety of by-products dependent upon the retort used.

Figure 2:
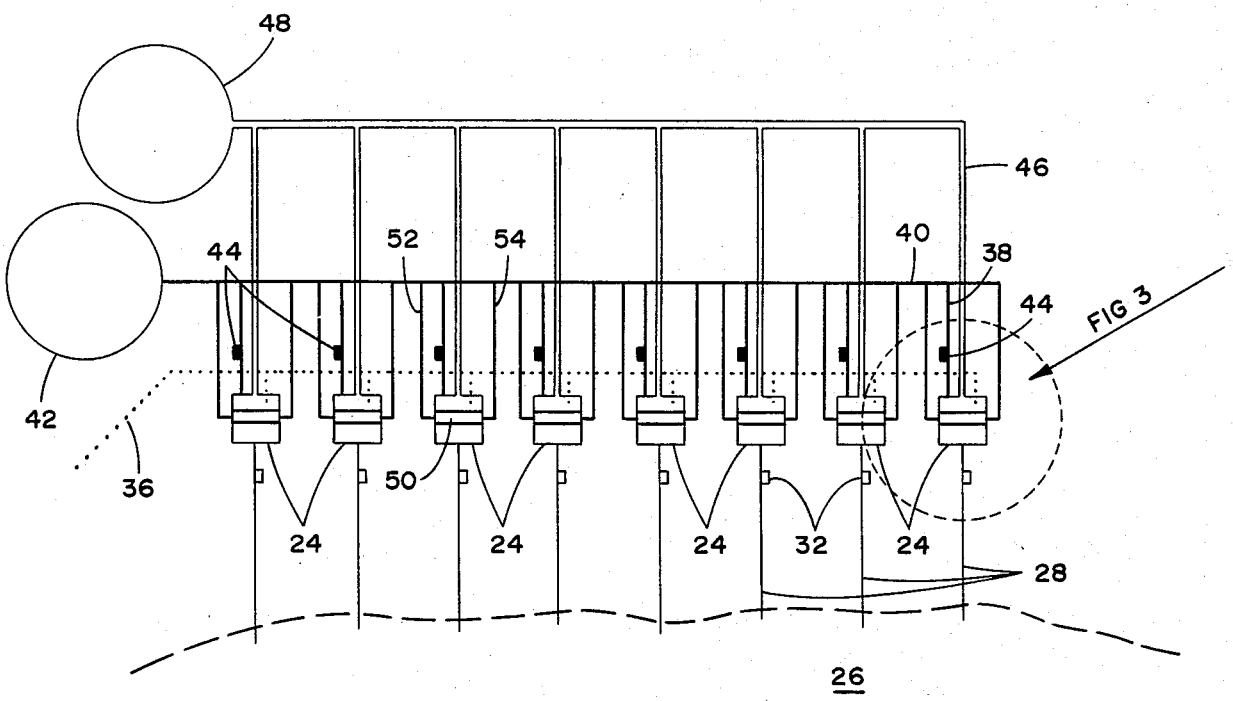
FIG. 2 is a general schematic representation of the shale oil collection operation.

FIG. 2 is a schematic representation of the shale oil collection operation from the invididual retorts. Thus, as can be seen in FIG. 2, the oil-bearing shale in stockpile 26 is coupled by means of individual conveyer belts 28 to the respective retorts 24. Each of the retorts 24 is coupled to a power line 36 which provides the electrical power necessary to operate the hydraulics, suction blower and gear motors. A conventional meter unit, not shown, at each retort monitors the total power consumed by the retort. If owned by different operators, they can be billed accordingly.

The kerogen released by the heated shale flows from each retort's individual product line 38 to a common product line 40 which transfers the kerogen to a storage tank 42. As the kerogen enters the individual product line 38 from a particular retort, it flows past a volume monitor 44 which measures and records the quantity of kerogen produced and contributed by each individual retort. If individually owned, the individual retort operator is paid according to this volume figure. Further, the meter reading from this volume monitor 44 may also be used, as necessary, for computing any royalties which may be owned to the land owner and/or lease payments owed to the land owner and/or least payments owed to the retort lessor.

The gaseous wastes from each retort 24 can be collected in parallel through a gaseous waste line 46 which leads to conventional environmental cleansing/by-product extraction hardward 48. Here the gaseous wastes are precipitated, filtered, and/or detoxified before the final wastes, in the form of carbon dioxide and water, are released into the free atmosphere. As previously noted, each retort can have its own environmental cleansing/by-product extraction hardward. It is also possible to entrain the wastes in the kerogen and permit waste removal at the refinery where waste treatment facilities already exist.

Since kerogen tends to become "jello-like" in consistency when its temperature drops below 85° F., individual product lines 38 and site product line 40 as well as storage tank 42 may be heated, as by being wrapped by a tubing loop. These loops may be connected to a heat exchanger 50 associated with each retort. The heat exchanger 50 would recover the converted heat from the retorts, resulting from on-going combustion and conduct the heat by suitable means to heat the individual product lines, the site product line, as well as the kerogen storage tank. The heat of the on-going combustion in each retort is utilized to maintain the kerogen in a fluid state. Heat can also be recovered from the spent shale clinker and if desired the recovered heat can be used to distill off certain fractions of the kerogen after it has been recovered from the oil shale.

Figure 3:
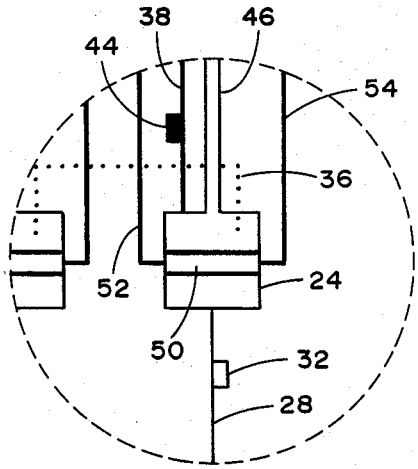
FIG. 3 is a more detailed schematic representation of an individual retort and its associated inputs and outputs.

FIG. 3 is a schematic representation of the portable nature of each of the individual retorts. As can be seen in FIG. 3, conveyer belt 28 is utilized to carry the oil-bearing shale from stockpile 26 to the retort 24. Manual controls 32 associated with the individual retort 24 are utilized by the operator thereof to regulate the amount of shale desired to be processed by that particular retort 24. An electrical input line 36 is coupled through an electrical plug to retort 24 to provide the necessary electrical power for operating the hydraulics, suction blower, gear motor, and other electrical devices thereon. It is old and well-known to place a watt meter in such a line so as to measure the amount of power being consumed by the unit so that the operator can be billed accordingly.

Not depicted is the skid-mounting for the retorts. This is conventinal in nature and tractors or other similar movers can be attached to the skid-mounting to move the individual retorts to any site desired. It will be evident that other means equivalent to skid mounts can be used to make the retorts portable or, if desired, motor means on the retort itself operatively connected to motive means; i.e., wheels, continuous track, and the like, mounted on the bottom of the retorts can be used to move the retorts when desired.

The kerogen produced by retort 24 during the combustion operations is collected through line 38 which transfers the kerogen through a site product line to the kerogen storage tank. Volume monitor 44 records the quantity of kerogen produced by the individual retort, if individual operators are used. The retort operator is paid according to this volume figure. This kerogen connecting line may be coupled to retort 24 by means of a quick disconnect coupling in a manner that is old and well-known in the art.

In like manner, the gaseous wastes from retort 24 are collected by waste line 46 which leads to the environmental cleansing/by-product extraction hardware 48 as explained earlier. Again, this line may be coupled to retort 24 by means of a quick disconnect coupling in a manner that is old and well-known in the art. As previously noted, each retort may have its own environmental controls.

Finally, heat exchanger 50 may have coupled thereto an outlet line 52 for carrying heat away from the retort 24 and an inlet line 54 for providing a return flow to retort 24. Line 52 may be used to wrap line 38 and site product line 40 as well as the kerogen storage tank 42 to maintain the kerogen in a liquid state or other alternative uses as previously described.

The retorts used in the present invention can be any one of the successfully used retorts such as the Union Oil rock pump retorts (Types A and B), the Cameron and Jones kiln, or the retorts used in the Paraho, Superior, and Tosco oil shale processes as described on pages 263 to 270 of the text "The Energy Source Book", edited by McRae et al. Certain of these and other retorts are disclosed in U.S. Pat. Nos. 2,875,137 to Lieffers et al., 3,162,583 to Hemmingef et al., and 3,908,865 to Day. These retorts are cited for illustrative purposes only and not by way of limitation. It is also pointed out that these retorts must be made of a size to be portative and provided with means to make them portative.

Figure 4:
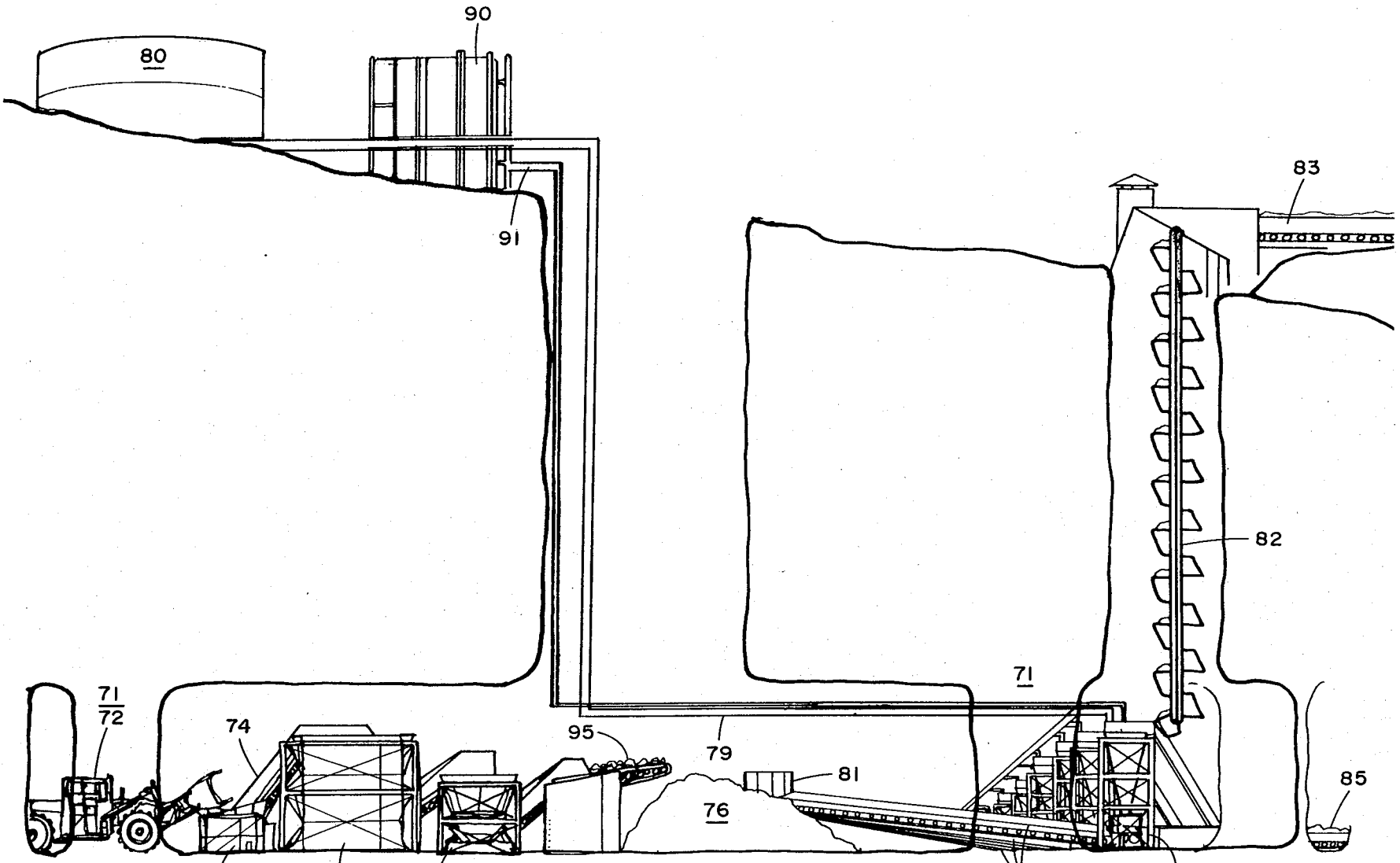
FIG. 4 is a cross-sectional schematic representation of a room and pillar mining system in accord with the present invention.

FIG. 4 illustrates a preferred embodiment of the present invention wherein underground mining and recovery of the oil is effected. There is shown a conventional room and pillar mine 70 having sufficient pillars 71 to support the mine. Conventional mining equipment (not shown) is used to mine the shale from the mine face and the shale is conveyed, as by front-end loaders 72, to conventional crushers 73. The crushed shale is moved by conveyors 74 to a screen 99, then through a second crusher 75 (if necessary), and then the crushed ore is placed into feeder piles 76 by radial stacker 95. A plurality of conveyors 77 carry the crushed shale from piles 76 to retorts 78. The kerogen is moved by pipes 79 to storage tank 80 located on the surface. The other by-products are conveyed to recovery tank 90 by pipes 91.

The spent shale is moved by means of conveyors 85 to a portion of the mine already mined where it is disposed of and the excess spent shale is moved by means of conveyors (not shown) to an appropriate storage area where the excess spent shale is carried to the surface by suitable elevator means, such as the continuous bucket system 82, and onto surface conveyor 83 for transport to a suitable surface dump site. If desired, the spent shale can be treated with a suitable aqueous solution in tank 81 to solubilize and remove the alkaline cations therefrom prior to carrying the residue to buckets 82 for disposal as previously described. These alkaline materials can then be disposed of in the mine thereby eliminating a major problem with respect to surface deposit of the excess spent shale.

Figure 5:
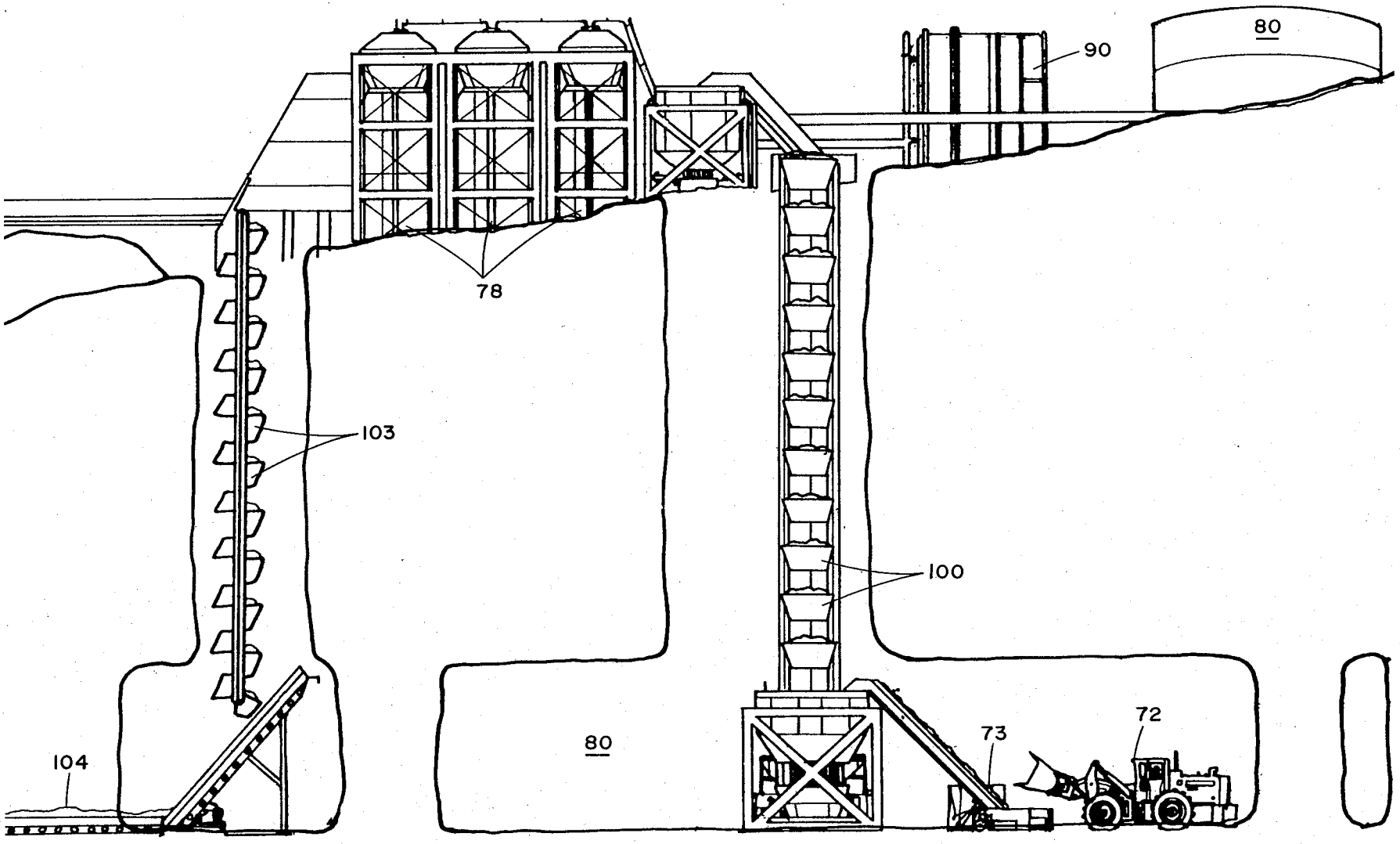
FIG. 5 is a cross-sectional schematic representation of a similar room and pillar mining system in accord with present conventional practice.

The system shown in FIG. 5 combines, again, room and pillar mining, but with surface retorting and stationary retorts. It is not as economically suitable in that all the oil shale must be conveyed to the surface, not just the excess shale as with the system of the present invention shown in FIG. 4. In this embodiment, the shale mined in mine 80 is conveyed by loader 72 to crusher 73, screened, lifted to the surface in buckets 100, and there secondarily crushed. The crushed shale is then fed to non-mobile retorts 78 and the kerogen conveyed to storage tank 80 and other recoverable by-products to recovery tank 90. The spent shale to be placed back into the already mined area of the mine can be lowered by means of buckets 103 into the mine and conveyed by means of conveyors 104 to the area where it is to be dumped. Such a system is significantly less economic. In addition, the reduced distances over which the spent shale must be transported is, by virtue of the retort mobility, greatly minimized and avoids the requirement of slurrying the shale residue as foreseen necessary in the large immobile facilities thereby avoiding the necessity of large water useage.

The use of small portative retorts is advantageous over large retorts even in surface mining in that much less land is required for economic mining as the retorts can be readily moved from place to place over the mining area.

The process of the invention is largely evident from the foregoing description of the apparatus system.

Thus, there has been disclosed an oil recovery system in which kerogen is recovered from oil-bearing shale which permits economic recovery and in a manner which allows, if desired, individual operators to share the enormous costs that are involved in the production of such shale oil and yet which allows each operator to set up a portable retort on the site of the oil-bearing shale or to purchase from the land owner or other proper individual the amount of shale necessary for continually operating the retort as many hours a day as necessary and to supply the recovered shale oil to a common collection system and to have the gaseous waste supplied to a common collection system for purification. The costs thus become managable and allow a shale oil recovery operation which could not be effectively handled by one operator.

While the instant invention has been described in detail with respect to recovery of oil from oil shale, it is also applicable to recovery of oil from tar sand and coal gasification. The applicability arises from the fact that in these other energy recovery efforts, large scale mining of the sands and coal is well-known and efficient, but the recovery of the oil from the sand and gasification of the coal have been hampered by the cost of scaling up the recovery devices; i.e., retorts, kilns, and the like. As with shale oil recovery of the instant invention, this problem can be overcome by using a sufficient number of the already proven pilot scale recovery units which are made portative and which avoid the problems, economic and mechanical, of scaling up. In short, the instant novel system of mating large scale mining techniques with small scale portative retorts to provide economic and efficient recovery of oil from oil shale can be applied to recovery of oil from tar sands and to coal gasification.

While the invention has been described in connection with a preferred embodiment, it is not intended to limit the scope of the invention to the particular form set forth but, on the contrary, it is intended to cover such alternatives, modifications, and equivalents as may be included within the spirit and scope of the invention as defined by the appended claims.

What is claimed is:

1. A system for extraction of a hydrocarbon fuel from a hydrocarbon fuel-bearing ore comprising:
   a. means for mining the ore,
   b. a plurality of separately and individually portative retorts for processing said ore to produce a hydrocarbon fuel,
   c. means for selectively and separately transporting said mined ore to each of said retorts,
   d. means coupled to said transport means for selectively and separately regulating the amount of ore transported to a respective retort, and
   e. at least one storage device coupled to said retorts for collecting and storing said hydrocarbon fuel.

2. A system as in claim 1 further including means coupled to each separate retort for individually processing and purifying gaseous wastes generated during a production of the hydrocarbon fuel.

3. A system as in claim 2 further including:

(a) heat exchanger means coupled to each of said retorts to remove heat therefrom, and (b) means coupled to each of said heat exchangers and said fuel storage and collecting device for transferring said heat from said heat exchanger to said at least one storage and collecting device for maintaining said hydrocarbon fuel in a fluid state.

4. An underground mining system for extraction of a hydrocarbon fuel from an underground hydrocarbon fuel-bearing ore comprising:

(a) means located underground to form a chamber and to mine the ore, (b) a plurality of portative retorts in said chamber for processing said ore to produce a hydrocarbon fuel, (c) means located underground for transporting said mined ore to each of said retorts, (d) means coupled to said transport means for regulating the amount of ore transported to a respective retort, and (e) at least one storage device located in said chamber or above ground and coupled to said retorts for collecting and storing said hydrocarbon fuel.

5. A system as in claim 4 further including means coupled to each retort for processing and purifying gaseous wastes generated during production of the hydrocarbon fuel.

6. A system as in claim 5 further including:

(a) heat exchanger means coupled to each of said retort to remove heat therefrom, and (b) means coupled to each of said heat exchanges and said at least one fuel and collecting device for maintaining said hydrocarbon fuel in a fluid state.

7. A system for extraction of oil from an oil-bearing shale comprising:

a. means for mining the oil-bearing shale, b. a plurality of separately and individually portative retorts for pyrolyzing said oil-bearing shale to produce oil-bearing fluid, c. means for selectively and individually transporting said mined oil-bearing shale to each of said retorts, d. means coupled to said transport means for selectively and separately regulating the amount of shale transported to a respective retort, e. at least one storage device coupled to said retorts for collecting and storing said oil-bearing fluid.

8. A system as in claim 7 wherein all of said mining means, retorts, transporting means, and regulating means are of a size adapted to and are located underground.

9. A system as in claim 8 further including means coupled to each retort for processing and purifying gaseous wastes generated during production of the oil-bearing fluid.

10. A system as in claim 8 further including:

(a) heat exchanger means coupled to each of said retorts to remove heat therefrom, and (b) means coupled to each of said heat exchangers and said oil storage and collecting device for transferring said heat from said heat exchanger to said at least one storage and collecting device for maintaining said oil-bearing fluid in a fluid state.

11. A method of extracting oil from oil-bearing shale comprising the steps of:

(a) forming an underground chamber in a vein of oil-bearing shale, (b) mining the shale in said vein, (c) conveying said mined shale to a plurality of portative retorts of a size to fit in and located in said chamber, (d) processing said shale in said retorts to produce an oil-bearing fluid, and (e) moving the retorts in consonance with movement of mining of said shale.

12. A method as in claim 11 wherein the spent shale is disposed of in areas already mined and any excess spent shale conveyed to the surface for disposal.

13. A method as in claim 11 wherein the chamber includes pillars to support the same comprising oil-bearing shale, which pillars are subsequently rubbleized and subjected to in situ processing to recover the oil-bearing fluid therefrom.

* * * * *